United States Patent [19]

Bittel et al.

[11] Patent Number: 4,735,051

[45] Date of Patent: Apr. 5, 1988

[54] DOUBLE ADMITTING PRESSURE INTENSIFIER

[75] Inventors: Karl Bittel; Rudi Bardoux, both of Leipzig, German Democratic Rep.

[73] Assignee: Veb Kombinat Orsta-Hydraulik, Leipzig, German Democratic Rep.

[21] Appl. No.: 742,620

[22] Filed: Jun. 7, 1985

[30] Foreign Application Priority Data

Jun. 7, 1984 [DD] German Democratic Rep. ... 263878

[51] Int. Cl.[4] ..... F15B 7/02

[52] U.S. Cl. ..... 60/537; 60/593; 91/290; 91/319

[58] Field of Search ..... 91/290, 319; 60/537, 60/547.1, 593; 417/225, 400

[56] References Cited

U.S. PATENT DOCUMENTS

| | | | |
|---|---|---|---|
| 2,652,780 | 9/1953 | Adams | 417/400 |
| 3,186,169 | 6/1965 | Hauser | 91/290 |
| 3,713,755 | 1/1973 | Scheffer | 417/469 |
| 3,780,621 | 12/1973 | Romell | 91/290 |
| 4,212,597 | 7/1980 | Mallofre | 91/319 |
| 4,281,587 | 8/1981 | Garcia-Crespo | 91/290 |
| 4,397,614 | 8/1983 | Larner | 417/403 |

FOREIGN PATENT DOCUMENTS

| | | | |
|---|---|---|---|
| 2159890 | 12/1985 | United Kingdom | 417/225 |

*Primary Examiner*—Abraham Hershkovitz
*Attorney, Agent, or Firm*—Horst M. Kasper

[57] ABSTRACT

A double admitting pressure intensifier which automatically reverses at its end positions is provided. The pressure intensifier comprises a pressure intensifier piston and a control slider running parallel to the pressure intensifier piston, each disposed in a bore of a casing. The control slider receives a control impulse only at the end of a stroke in order to maintain the pressure intensifier trouble-free under all conditions. This is assured by disposing two pressure pins of different diameter projection into axial bores of the control slider. The pressure pin with the larger diameter is connected to the feed line or, respectively, to the discharge port depending on the position of the pressure intensifier piston. The pressure pin with the smaller diameter is, on the other hand, continuously connected with the feed line.

9 Claims, 2 Drawing Sheets

DOUBLE ADMITTING PRESSURE INTENSIFIER

BACKGROUND OF THE INVENTION

1. Field of the Invention

The present invention relates to a double admitting pressure intensifier where the pressure intensifier piston is automatically controlled and reversed in the end positions by a control slider, which control slider is disposed in parallel to the pressure intensifier piston.

2. Brief Description of the Background of the Invention Including Prior Art

Pressure intensifiers have been proposed where the reversal of the direction of motion of the pressure intensifier piston is provided by a control shell surrounding the pressure intensifier piston or by a control slider disposed for running in parallel to the pressure intensifier piston. According to one embodiment with a control shell, this is in most cases shifted mechanically by way of stops of the pressure intensifier piston when approaching its end position and thus the admission stroke of the pressure intensifier piston is controlled. Since the mechanical control of the control shell does not result in a stable control despite corresponding auxiliary steps in the end positions, a hydraulic control has been created. According to the hydraulic control, the annular surface of two bands at the outer diameter of the control shell or front faces at the ends of this control shell are connected alternatingly depending on the position of the pressure intensifier piston to the pressure or the discharge side. The adjustment motion of the control shell in that case always runs against the direction of motion of the pressure intensifier piston. The control bores cut in the control shell are rapidly and completely released by the opposite motion relative to the pressure intensifier piston, whereby the control shell is shifted alternatingly in each case into a different position such that a stable reversal of the direction of motion of the pressure intensifier piston is provided under any conditions, for example if a large or a small transported flow or, respectively, pressure is present. The safe control and direction reversal of the pressure intensifier piston thus is associated with a geometrical coordination of the pressure intensifier piston to the control shell and this appears to be possible only if the pressure intensifier piston and the control shell are touching or, respectively, if the pressure intensifier piston is surrounded by the control shell. This coaxial coordination of the pressure intensifier piston and of the control shell, in particular if the latter is surrounded by three further control bushings, is disadvantageous from a production, manufacturing point of view. Small deviations from coaxiality result in a clamping of the control shell if the gaps and thus the leakage losses are to be kept to a small value.

Therefore, an embodiment with a control slider running parallel to the pressure intensifier piston has been proposed. The control slider is provided with two flat control grooves in its middle part.

The bore for the pressure intensifier piston is connected via a control bore to a feed line and on either side of this control bore and at a certain distance from it, is connected by a control bore to the discharge port. Two closely neighboring bores are disposed on each side in between and somewhat staggered relative to the side bores, which bores connect the bore of the control slider to the pressure intensifier piston.

The pressure intensifier piston is provided with two inner, somewhat broader, flat and two outer, somewhat narrower control grooves which release and open or, respectively, cover the mentioned control bores. The proposed pressure intensifier however does not work satisfactorily under all operating conditions. In particular, difficulties occur if in the case of a high counter pressure, the primary stream goes to zero because the primary pressure limiting valve is engaged. Then the control slider becomes stuck in the middle position. Several causes exist for this situation. The main cause is that a pressure pulse is exerted on the control slider by the control grooves during the lift stroke of the pressure intensifier piston. Since the neighboring bores in the casing are closely spaced in the axial direction relative to each other, their operation activity is eliminated by the loss of the gap.

SUMMARY OF THE INVENTION

1. Purposes of the Invention

It is an object of the present invention to provide a pressure intensifier which operates safely and assuredly under any operating conditions.

It is a further object of the present invention to provide a pressure intensifier where the control slider receives a reversal control pulse only at the lift ends in each case.

It is a further object of the present invention to provide a pressure intensifier employing a control slider where a shifting of the position of the control slider is eliminated during the lift stroke of the pressure intensifier piston.

These and other objects and advantages of the present invention will become evident from the description which follows.

2. Brief Description of the Invention

The present invention provides a double acting and at limit positions automatically reversing pressure intensifier which has a case having a first bore hole and a second bore hole. A pressure intensifier piston slides in the first bore hole of the case and subdivides the first bore hole into two low pressure work volumes. The pressure intensifier piston is furnished with control grooves at the outer circumference and with two cylindrical bore holes. A first high pressure piston is solidly mounted to the case for sliding relative to and inside of a cylindrical bore hole of the pressure intensifier piston. A check valve disposed in the pressure intensifier piston connects the two bore holes of the casing. A control slider is disposed in the second bore hole of the casing and is provided with a first bore hole at a first of its two ends and with a second bore hole at the second of its two ends. Each bore hole protrudes into the slider. The control slider is furnished with a control groove about at its middle region, which control groove is connected to the first bore hole of the slider. A first pressure pin of a first diameter is attached to the casing and protrudes into the first bore hole of the slider. A second pressure pin having a smaller diameter than the diameter of the first pressure pin protrudes into the second bore hole of the slider.

A first flat control groove is disposed at the outside of the pressure intensifier piston. A first control bore in the case provides a connection between the first flat control groove and a discharge bore in the case depending on the position of the pressure intensifier piston.

A second flat control groove is disposed at the outside of the pressure intensifier piston. A second control bore in the case provides a connection depending on the position of the pressure intensifier piston between the second flat control groove and a feed bore in the case. The second pressure pin with the smaller diameter is continuously connected via its axial bore and cross bores to the feed bore. The width of the single center control groove of the slider is about the distance between two control bores running to the slider guide wall.

The control slider can be provided on two sides of its jacket surface with a wide and deep relief passage groove and on its front faces with axial bores.

The bore in which the control slider moves back and forth can be provided on each side with three relief passage grooves. The two outer relief passage grooves can be connected via individual bores with a discharge bore running in a bore parallel to the control slider bore. The two inner relief passage grooves can be connected via individual bores with a feed bore running parallel to the control slider bore. The two middle relief passage grooves can be connected to the low pressure work spaces of the pressure intensifier via two bores for each one.

A high pressure working area can be provided by a closure cap having a bore. A second high pressure piston attached to the pressure intensifier piston can penetrate into the bore.

Another high pressure working area can be formed by the pressure intensifier piston. The first high pressure piston supported by a pressure piece can penetrate into this working area.

The ratio of the cross-section of the first high pressure piston to the cross-section of the second high pressure piston can be about 2:1.

The high pressure working areas can be connected via a check valve which opens in the direction toward the high pressure work area with the smaller diameter.

A spring can be supported against the case and can provide a force to the high pressure piston acting in the direction of the check valve.

The pressure intensifier piston can form a first and a second working area where the closure of the second working area is provided by a closure inserted into the casing.

Another aspect of the present invention provides a method for intensifying the pressure of a fluid which comprises the following:

Hydraulic fluid at a desired pre-pressure is fed to a stationary cylinder bore in a first bore hole in a case and is fed at a working pressure to a second bore hole in the case.

A pressure intensifier piston having a cylindrical bore hole for surrounding the stationary cylinder is disposed in the first bore hole.

A second high pressure piston is attached to a bore in the pressure intensifier piston.

Hydraulic working fluid is provided to the case.

The hydraulic working fluid flow lines are switched with a control slider disposed in the second bore hole of the case for driving the pressure intensifier piston to apply pressure to a high pressure medium.

Hydraulic work fluid is fed via a control groove in the circumference of the pressure intensifier piston to move the slider from one limiting position to the other when the pressure intensifier piston reaches a limiting position.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which is shown one of the various possible embodiments of the present invention.

DESCRIPTION OF INVENTION AND PREFERRED EMBODIMENTS

Figure 1:
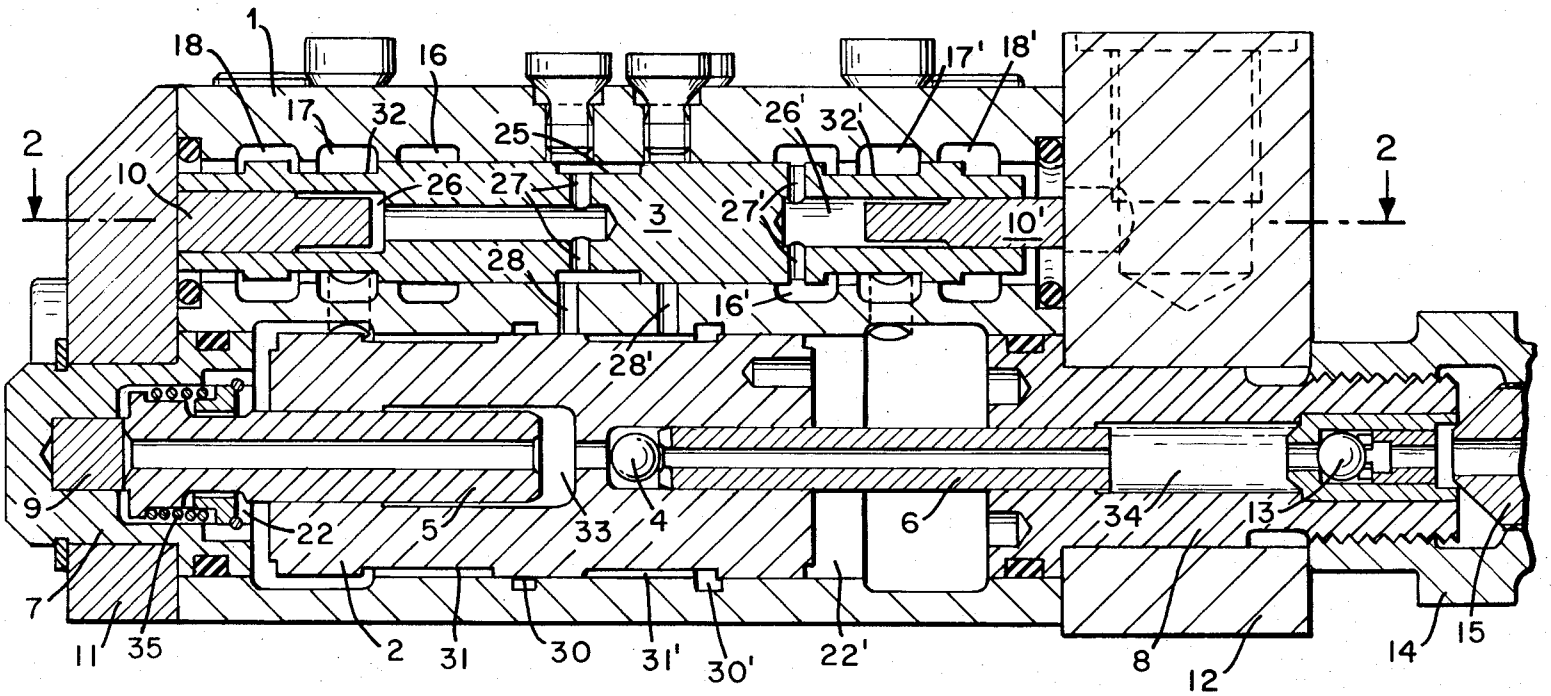
FIG. 1 is an axial sectional view through a pressure intensifier according to the invention.
Figure 2:
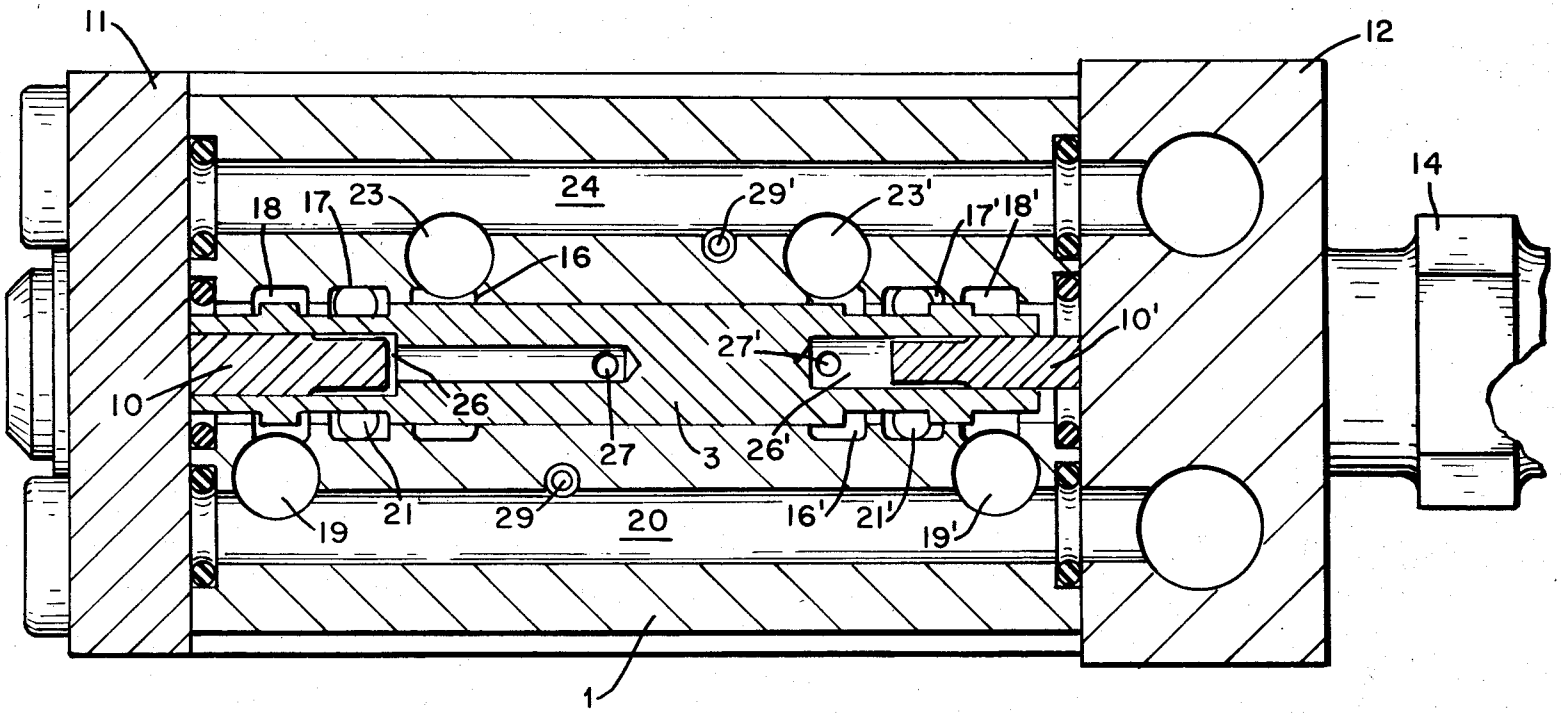
FIG. 2 is a sectional view of the control slider of the pressure intensifier of FIG. 1, which section is rotated by 90 degrees relative to the section of the view of FIG. 1.

In accordance with the present invention, there is provided a double acting pressure intensifier which reverses automatically at the end positions and which pressure intensifier comprises a casing wherein a pressure intensifier piston and a control slider running parallel to the pressure intensifier piston are disposed. The pressure intensifier piston has at its jacket face control grooves, and the bore wherein the pressure intensifier piston moves is subdivided into two low pressure working areas. The control slider, which has a wide and deep passage flow groove on each of two sides of its jacket face, is provided with axial bores on its front side, while the bore in which the control slider moves, is furnished on each of the two sides with three relief passage grooves, of which the two outer ones are connected via a bore in each case with a discharge bore running in parallel to the control slider bore. The two inner relief passage grooves are connected with a feed bore running in parallel to the control slider bore. The middle relief passage grooves are connected via in each case two bores to the low pressure working areas of the pressure intensifier.

Pressure pins 10, 10' of different diameter protrude into the axial bores 26, 26' of the control slider 3, where the pressure pins 10, 10' are supporting the case 1. The pressure pin 10 with the larger diameter has a connection via its axial bore 26 and in principle known cross bores 27 to a control groove 25 disposed in the middle of the jacket faces of the control slider 3. The control groove 25 is connected via control bores 28, 28' in the case 1 depending on the position of the pressure intensifier piston 2, via the flat control grooves 31, 31' of the pressure intensifier piston 2 and via grooves 30, 30' in the bore of the pressure intensifier piston 2 and control bores 29, 29' with the feed bore 24 or to the discharge port 20, while the pressure pin 10' with the smaller diameter is connected via its axial bore 26' and via in principle known cross bores 27' continuously via the corresponding interior relief passage groove 16' to the feed line bore 24, where the width of the individual center control groove 25 of the control slider 3 is equal to the distance between two control bores 28, 28' in the casing 1.

Preferably a high pressure working area 34 is formed by a closure 8, into the bore of which a high pressure piston 6 penetrates, which high pressure piston 6 is attached to a bore of the pressure intensifier piston 2. The other high pressure working area 33 is formed by the pressure intensifier piston 2 where the high pressure piston 5 penetrates into the bore of the pressure intensifier piston 2. The high pressure piston 5 is supported on a pressure piece 9 disposed in a closure 7. The cross sections of the high pressure pistons 5, 6 have a ratio of preferably about 2:1, and the high pressure working areas 33, 34 are connected via a check valve 4 opening to the smaller high pressure working area space 34.

Referring now to FIG. 1, there is shown a cross section of a casing 1, where the pressure intensifier piston 2 is disposed in the larger bore of the casing and where the control slider 3 is disposed in a sliding position in the smaller bore disposed above the larger bore. The check valve 4 is disposed in the pressure intensifier piston 2, and at the two front faces of the pressure intensifier piston 2 there are disposed slidingly or, respectively, fixedly, the high pressure pistons 5, 6. The high pressure piston 5 is supported by a pressure piece 9 disposed in a closure 7. The high pressure piston 6 is pressed into the right base bore of the pressure intensifier piston 2 and slides in the bore of a closure 8. Two differently sized pressure pins 10, 10' are disposed in axial bores of the control slider 3 on the left and right hand sides. The pressure pins 10, 10' are supported, as are the closures 7, 8, on the covers 11, 12. The closure 8 comprises a relief valve 13. A high pressure connection 15 can be clamped to the end of the line with a screwed cap or sleeve 14.

The bore for the control slider 3 is provided in a symmetrical way on the left hand and on the right hand with three relief passage grooves 16, 17, 18; 16', 17', 18'. The outer relief passage grooves 18, 18' are connected via the bores 19, 19' to a discharge port 20. The center relief passage grooves 17, 17' are connected via bores 21, 21' to the low pressure working space 22, 22' of the pressure intensifier piston 2, while the inner relief passage grooves 16, 16' are connected via bores 23, 23' to a feed bore 24. The relief passage grooves 16, 16'; 18, 18' can be connected to the low pressure working spaces 22, 22' of the pressure intensifier piston 2 depending on the position of the control slider 3. In this case, one side is connected to the discharge and the other side is connected to the feed line and vice versa.

The control slider 3 is provided in its center region with a flat control groove 25 which is connected via cross bores 27 to the axial bore 26 of the control slider 3. A pressure pin 10 is disposed slidingly and sealingly in the axial bore 26. A further axial bore 26', which is provided with a smaller diameter, is disposed on the other side of the control slider 3. It holds the other pressure pin 10'. The axial bore 26' is connected via cross bores 27 to the relief passage groove 16' and is thus continuously under the pressure of pressurized oil.

Two control bores 28, 28' are disposed between the bores for the pressure intensifier piston 2 and the control slider 3, and these control bores control the elements cited. A little further toward the outside there is also provided about symmetrically to the center two control bores 29, 29' where the first connects the bore for the pressure intensifier piston 2 to the discharge port 20 and the second connects the bore for the pressure intensifier piston 2 to the feed line bore 24. The bores 29, 29' lead to the grooves 30, 30'.

The pressure intensifier piston 2 is provided with two flat control grooves 31, 31'. The control slider 3 is furnished at its ends in each case with a wide and deep relief passage groove 32, 32'. The pressure intensifier piston 2 in association with the high pressure piston 5 forms a high pressure working area 33, and the high pressure piston 6 in association with the closure 8 provides a second high pressure working area 34. The high pressure piston 5 is engaged by a spring 35 in the direction toward the pressure piece 9.

The mode of operation of this double admitting pressure intensifier is as follows: The pressure intensifier piston 2 is as shown in the drawing in its left postion about shortly before change of control to reverse. The right edge of the control groove 25 of the control slider 3 covers the right control bore 28'. Although the right control groove 31 of the pressure intensifier piston 2 has released the control bore 28', as yet no control oil stream can flow to one of the two control bores 28, 28'. This is because one of them is closed by the pressure intensifier piston 2 and the other is closed by the control slider 3. Only if the pressure intensifier piston 2 moves further toward the left, does a control oil stream flow via the control bore 28 and further via the control groove 25 of the control slider 3 through the cross bore 27 of the left axial bore 26 of the control slider 3, impinges the left pressure pin 10 in the control slider 3 and thus presses the control slider 3 to the right side. This is made possible because the cross section of the left pressure pin 10 is larger than the cross section of the right pressure pin 10'. Thus the right edge of the control groove 25 of the control slider 3 releases the right control bore 28', such that even in the case of initial reversal of motion of the pressure intensifier piston 2 there remains a sufficient time for the control slider 3 to reach the end position on the right. Before movement of the pressure intensifier piston 2 to the right side again closes first the control bore 28 and then the control bore 28', the pressure intensifier piston 2 has passed about slightly more than half of its lift stroke. During this lift stroke, the control slider 3 is shifted to the right hand side or, respectively, is maintained in such a position. Only if the pressure intensifier piston 2 reaches the right end position, does its left control groove 31 release and open the right control bore 28'. The left control bore 28 is still closed by the control slider 3. The control bore 28 or, respectively, 28' is connected to the control bore 29 for the discharge. Then the pressure pin 10 can be pressed into the axial bore 26. This is achieved by the pressure continuously applied to the cross bores 27' and by the smaller pressure acting continuously on the pressure pin 10'. Since no pressure is thus exerted on the pressure pin 10, the continuous pressure acting on the pressure pin 10' causes the control slider 3 to be shifted towards the left.

According to the control of the control slider 3 by the pressure intensifier piston 2 as described, the pressure intensifier piston 2 is alternatingly impinged on one side by feed pressure and on the other side by the discharge line. According to the position shown in the drawing, the high pressure piston 5, whose left front face is at the same time the valve seat of the pressure piece 9, still rests against the pressure piece 9. The check valve 4 is still open. A slight amount of high pressure oil is shifted out from the high pressure working area via the check valve 4 and exit valve 13. With a reversal of direction of the motion, the high pressure piston 5 acting as a suction valve lifts off from the pressure piece 9. This opening against the spring 35, effecting a closure, is performed by the forces acting on the unequal faces of the high pressure piston 5. The inner face of the high pressure piston 5 is larger than the seating face with which the high pressure piston 5 is seated on the pressure piece 9. The oil is shifted out from the high pressure working area 35 through the exit valve 13 by the pressure intensifier piston 2 moving toward the right.

At the same time, the high pressure working area 33 is filled with low pressure oil for a double stroke. The volume of the chamber 33 is twice as large as the volume which was moved out during the same time from the high pressure working area 34.

When the pressure intensifier piston 2 again moves toward the left, the high pressure piston 5 closes. The oil from the high pressure work area 33 is shifted via the check valve 4 into the high pressure working area 34 and from there is shifted out via the exit valve 13.

Since the cross sections of the high pressure pistons 5, 6 have a ratio of about 2:1, their lift volumes have the same ratio. Therefore, independently of whether the pressure intensifier piston 2 moves from the left or from the right, the same volume is always shifted out through the exit valve 13.

It will be understood that each of the elements described above, or two or more together, may also find a useful application in other types of system configurations and double admitting pressure intensifiers differing from the type described above.

While the invention has been illustrated and described as embodied in the context of a double admitting pressure intensifier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A double acting and at limit positions automatically reversing pressure intensifier comprising a case having a first bore hole and a second bore hole;

a pressure intensifier piston sliding in the first bore hole of the case, subdividing the first bore hole into two low pressure work volumes and furnished with two cylindrical bore holes;

a first high pressure piston mounted in the case for sliding relative to and inside of a cylindrical bore hole of the pressure intensifier piston;

a check valve disposed in the pressure intensifier piston for controlling fluid communication between the two bore holes in the piston;

a control slider disposed in the second bore hole of the case provided with a first bore hole at a first of the two ends and with a second bore hole at the second of the two ends of the slider with each bore hole protruding into the slider and the slider furnished with a control groove about its middle region connected to the first bore hole of the slider;

a first pressure pin of a first diameter attached to the casing and protruding into the first bore hole of the slider;

a second pressure pin having a smaller diameter as compared with the diameter of the first pressure pin and protruding into the second bore hole of the slider;

a first flat control groove disposed at the outside of the pressure intensifier piston;

a first control bore in the case for providing a connection depending on the position of the pressure intensifier piston between the first flat control groove and a discharge bore in the case;

a second flat control groove disposed at the outside of the pressure intensifier piston;

a second control bore in the case for providing a connection depending on the position of the pressure intensifier piston between the second flat control groove and a feed bore in the case, wherein the second pressure pin with the smaller diameter is continuously connected via an axial bore in the slider and cross bores in the slider to the feed bore, wherein the width of the control groove of the slider is about the distance between two control bores positioned in a slider guide wall located in the case.

2. The double acting and at limit positions automatically reversing pressure intensifier according to claim 1 wherein the control slider has front faces and a jacket surface and is provided on two sides of its jacket surface with a wide and deep relief passage groove and on its front faces with axial bores.

3. The double acting and at limit positions automatically reversing pressure intensifier according to claim 1 wherein the bore in which the control slider moves back and forth is provided on each side with three relief passage grooves, of which the two outer ones are connected with a discharge bore running in parallel to the control slider bore via a bore for each one, of which the two inner ones are connected with a feed bore running in parallel to the control slider bore via a bore for each one, and of which the two middle ones are connected to the low pressure work spaces of the pressure intensifier via two bores for each one.

4. The double acting and at limit positions automatically reversing pressure intensifier according to claim 1 wherein a high pressure working area is provided by a closure cap having a bore and a second high pressure piston attached to the pressure intensifier piston penetrates into the bore.

5. The double acting and at limit positions automatically reversing pressure intensifier according to claim 4 wherein another high pressure working area is formed by the pressure intensifier piston and the first high pressure piston supported by a pressure piece penetrates into this working area.

6. The double acting and at limit positions automatically reversing pressure intensifier according to claim 5 wherein the ratio of the cross-section of the first high pressure piston to the cross-section of the second high pressure piston is about 2:1.

7. The double acting and at limit positions automatically reversing pressure intensifier according to claim 6 wherein the high pressure working areas are connected via the check valve which opens up in the direction toward the high pressure work area with the smaller diameter.

8. The double acting and at limit positions automatically reversing pressure intensifier according to claim 5 further comprising a spring supported against the case and providing a force to the first high pressure piston acting in a direction away from the check valve.

9. The double acting and at limit positions automatically reversing pressure intensifier according to claim 1 wherein the pressure intensifier piston forms in the case a first and a second working area and wherein closure of the second working area is provided by a closure member inserted into the case.

* * * * *